US005580359A

United States Patent [19]

Wright

[11] Patent Number: 5,580,359

[45] Date of Patent: Dec. 3, 1996

[54] IMPROVING THE EFFICIENCY OF FUEL COMBUSTION WITH A FUEL ADDITIVE COMPRISING TIN, ANTIMONY, LEAD AND MERCURY

[75] Inventor: Ralph Wright, South Hampton, England

[73] Assignee: Advanced Power Systems International, Inc., Farmington, Conn.

[21] Appl. No.: 528,363

[22] Filed: May 25, 1990

[30] Foreign Application Priority Data

May 26, 1989 [GB] United Kingdom ..... 8912592

[51] Int. Cl.[6] ..... C10L 1/14; C10L 9/10

[52] U.S. Cl. ..... 44/321; 44/354; 44/639; 431/4

[58] Field of Search ..... 431/4; 44/321, 44/639, 354

[56] References Cited

U.S. PATENT DOCUMENTS

| | | | |
|---|---|---|---|
| 3,507,789 | 4/1970 | Heilweil et al. | 44/321 |
| 3,944,697 | 11/1976 | Burke | 44/321 |
| 4,517,926 | 5/1985 | Reinhard et al. | 44/321 |
| 4,891,050 | 1/1990 | Bowers et al. | 44/361 |
| 4,892,562 | 1/1990 | Bowers et al. | 44/324 |

FOREIGN PATENT DOCUMENTS

| | | | |
|---|---|---|---|
| 459592 | 9/1949 | Canada | 44/321 |
| 2500683 | 7/1976 | Germany . | |

*Primary Examiner*—Jerry D. Johnson
*Attorney, Agent, or Firm*—Rogers & Killeen

[57] ABSTRACT

The efficiency of fuel combustion is improved by adding to the fuel an additive that includes tin, antimony, lead and mercury. The additive may include by weight 60–80% tin, 15–30% antimony, 2–7% lead and 3–12% mercury.

4 Claims, 1 Drawing Sheet

IMPROVING THE EFFICIENCY OF FUEL COMBUSTION WITH A FUEL ADDITIVE COMPRISING TIN, ANTIMONY, LEAD AND MERCURY

BACKGROUND OF THE INVENTION

The present invention relates generally to fuel additives and more particularly concerns a formulation of metals which when introduced into fuel can increase efficiency and performance, reduce wear on moving parts, reduce carbon deposits and improve exhaust emissions.

According to one aspect of the present invention, a fuel additive consists of tin, antimony, lead, and mercury. The preferred percentages by weight are, apart from impurities, 60 to 80 % wt. tin, 15 to 30 % wt. antimony, 2 to 7 % wt. lead and 3 to 12 % wt. mercury.

In use, it is believed that a chemical reaction takes place between the additive and the fuel and that the products of the chemical reaction are traced into the fuel in minute molecular form, thereby not only improving the combustion of the fuel but reducing the friction of moving parts in contact with the fuel.

The fuel may be, for example, any grade of oil, petrol or diesel. The introduction of the fuel additive may occur, for example, in a fuel storage tank or in a fuel line or both. The fuel storage tank may be formed of steel, in which case the chemical reaction may include the tank. Alternatively, the fuel storage tank may be formed of a plastics material, in which case the additive may be enveloped or otherwise housed in a steel container so that the chemical reaction may include the container. The fuel line may lead to, for example, an internal combustion engine, a boiler or furnace.

The fuel additive itself may be formed as a dry powder or a semi-dry paste. This is particularly convenient where the fuel additive is to be used primarily as a lubricant to reduce friction, or even totally as a lubricant in non-combustion applications, Alternatively, the fuel additive may be formed by, for example, casting, extruding, cutting or shaping to have the shape of, for example, a mesh, rod, plate, ball or tube. The fuel additive may be formed separately from other components. Alternatively, the fuel additive may be formed integrally with a component such as a fuel filter.

It is presently preferred that the fuel additive is cast into the shape of a cone.

It is also presently preferred that the fuel additive has a composition of 70 to 75 % wt. tin, 15 to 25 % wt. antimony, 2 to 4 % wt. lead and 3 to 7 % wt. mercury and is manufactured by the following method:

A) The tin, antimony and lead are melted together in a mild steel pot to approximately 50° C. above the melting temperature and the resultant liquid is stirred for 3 to 4 minutes using a mild steel rod or bar.

B) The mercury is added, the temperature is increased a further 50° to 100° C. and the resultant liquid is stirred for a further 2 minutes.

C) The liquid is poured, by use of a mild or stainless steel ladle, into cone-shaped moulds in a mould block, which if formed of mild steel and is pre-heated to a temperature sufficient to prevent the liquid from setting in less than one second after pouring.

Chill cooling adversely affects the metallurgical properties of the fuel additive.

It should be noted that mis-cast cones, or any of the formulation allowed to set in the melting pot, may be re-melted and re-cast provided that the total time lapse after the addition of the mercury does not exceed 45 minutes.

According to another aspect of the present invention, a fuel additive of any composition, but preferably a formulation of metals, is provided in combination with magnetic material such as permanent ferrite magnets, the intention being that the electrostatic charge on the fuel, and preferably also on the products of the chemical reaction, is altered in a beneficial manner.

The fuel additive, and its combination with magnetic material, in accordance with the present invention is shown, by way of example only, in the accompanying drawings in which.

Figure 1:
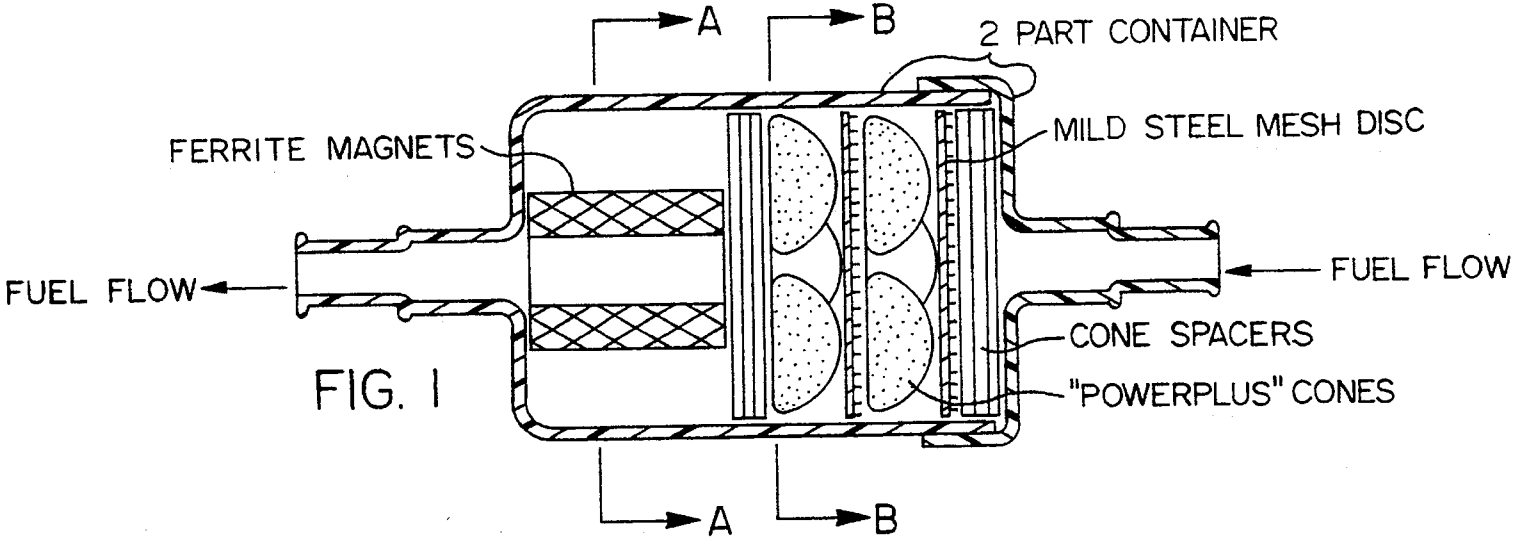
FIG. 1 is a longitudinal section through a container which houses the magnetic material as well as the fuel additive.
Figure 3:
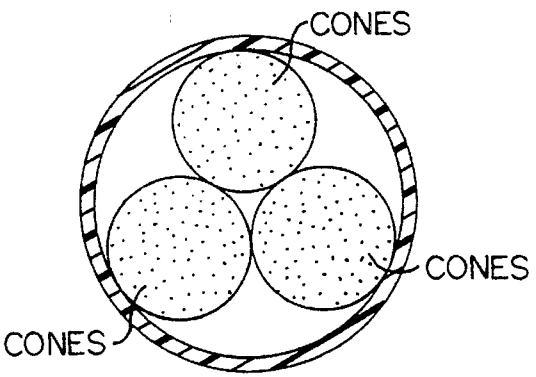
FIG. 3 is a cross-sectional view through the fuel additive taken along the line B—B of FIG. 1.
Figure 2:
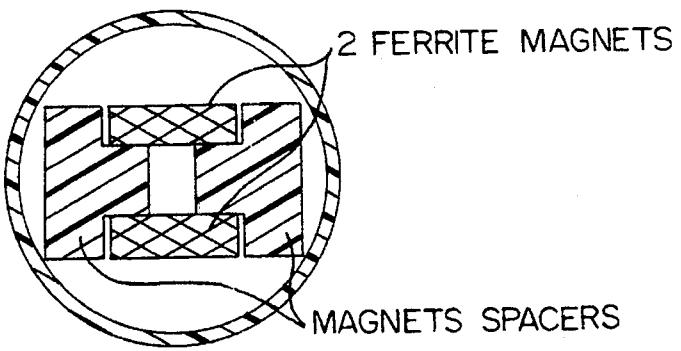
FIG. 2 is a cross-sectional view through the magnetic material taken along the line A—A of FIG. 1.

In the accompanying drawings, a cylindrical two-part container of plastics material is provided with a fuel inlet at one end a fuel outlet at the other end. In passing through the container, the fuel sequentially passes through spacers adjacent a mild steel mesh disc, a first set of three cones adjacent another mild steel mesh disc, a second set of three cones adjacent further spacers, and a pair of ferrite permanent magnets held in parallel relationship by a pair of magnet spacers of plastics material. The material of the cones is the fuel additive of the present invention, each of the cones having a base diameter of approximately 20 mm. Although six cones have been indicated, the particular number required naturally depends upon the particular application. Altering the number of the cones will naturally affect the number of the spacers, which are again of plastics material formed as circular discs with both perforations and protrusions. The number of the mild steel mesh discs may also be affected.

The purpose of the permanent magnets is to alter the electrostatic charge on the fuel as the fuel passes through the flux created by the permanent magnets so that the fuel is more likely to ignite and burn. In particular, the combustion chemistry of the fuel is enhanced and the rate of thermal heat transfer away from the combustion zone is increased. In an internal combustion engine, it is found that there is a smoother more efficient and reliable engine which lasts longer, the engine oil lasting longer and the carbon monoxide, nitric oxide and particulates in the exhaust emissions being reduced.

In a storage tank for oil, the fuel additive is also found to give the advantages of keeping the oil in better condition by reducing bacterial growth and reducing gelling in cold weather.

In an alternative embodiment, the additives may be made from an alloy which is approximately 75% weight tin, 21% weight antimony and 4% weight lead. To 5.0 kg of the alloy is added 0.5 kg of mercury (as a releasing agent) and 0.020 kg platinum (as a catalyst).

I claim:

1. A method for improving the efficiency of fuel combustion comprising the step of adding to the fuel to be burned an additive comprising by weight 60–80% tin, 15–30% antimony, 2–7% lead, and 3–12% mercury to allow said additive to react with the fuel whereby the products of the reaction improve combustion of the fuel.

2. The method as defined in claim 1 wherein said additive comprises the following percentages by weight: 70–75% tin; 15–25% antimony; 2–4% lead; and 3–7% mercury.

3. The method as defined in claim 2 wherein said additive reacts with the fuel in the presence of steel.

4. The method as defined in claim 3 wherein said additive reacts with the fuel in a fuel line leading to a place for burning the fuel.

* * * * *